US006085904A

United States Patent [19]

Perdue, Jr.

[11] Patent Number: 6,085,904

[45] Date of Patent: Jul. 11, 2000

[54] SELF STICK SINGLE FACE PACKAGE

[76] Inventor: Harry A. Perdue, Jr., 12001 Hoover Rd., Milan, Ohio 44846

[21] Appl. No.: 09/309,401

[22] Filed: May 10, 1999

Related U.S. Application Data

[60] Provisional application No. 60/086,328, May 21, 1998.

[51] Int. Cl.[7] ..... B65D 75/00

[52] U.S. Cl. ..... 206/484; 229/103.2; 229/5.81; 229/92.8; 229/87.05; 229/939

[58] Field of Search ..... 229/103.2, 122.21, 229/200, 238, 239, 5.81, 5.84, 92.8, 87.05, 939; 206/484, 524.3, 784, 525, 525.1; 493/148, 150, 151

[56] References Cited

U.S. PATENT DOCUMENTS 4,781,294 11/1988 Croce .
4,941,574 7/1990 Meehan ..... 206/484 X
5,135,790 8/1992 Kaplan et al. .
5,178,293 1/1993 Suzuki et al. ..... 206/484 X
5,704,481 1/1998 Lutz .

*Primary Examiner*—Jacob K. Ackun
*Attorney, Agent, or Firm*—Marshall & Melhorn

[57] ABSTRACT

The invention is a single face corrugated paperboard package for containing an article. The package includes a pair of paperboard sheets each having an interior surface and an exterior surface. A cohesive coating is applied over substantially the entire interior surface of each of the paperboard sheets. A tear strip is disposed on the interior surface of at least one of the paperboard sheets. The tear strip includes an uncoated portion. The uncoated portion has two opposed longitudinal sides defined by a pair of spaced apart lines of intermittent impressions. Optionally, the tear strip may also include a tape disposed between the pair of spaced apart lines of intermittent impressions. The pair of paperboard sheets may be formed from a single paperboard sheet. The invention also includes the method of making the same.

20 Claims, 5 Drawing Sheets

SELF STICK SINGLE FACE PACKAGE

RELATED APPLICATION

This application is claiming the benefit, under 35 U.S.C. § 119(e), of the provisional application filed May 21, 1998 under 35 U.S.C. § 111(b), which was granted a Ser. No. of 60/086,328. The provisional application, Ser. No. 60/086, 328, is hereby incorporated by reference.

BACKGROUND OF THE INVENTION

The present invention relates in general to shipping wrappers or packages and more particularly to tear-open, paperboard packages which are formed from corrugated paperboard sheet(s). An important aspect of this invention concerns a single-use corrugated paperboard package having a tear strip formed therein, which the package is especially suited to sending nonperishable rigid articles such as automotive parts or books and the like through the mail or by private carrier or shipper.

Packages for sending rigid articles have included end flaps and side flaps which are folded, inserted in preformed slots, glued and sealed. These prior art packages while generally reliable have required specially designed machinery to make the intricate folds and provide precise placement of glue or other adhesive. In addition, the large volume of articles sent by this type of packaging often mandates that the packaging be done quickly in automated systems. The numerous manipulative steps required to be performed by these specially designed automated systems, however, requires that they be relatively complex and expensive. A need exists therefore, for a package and method of packaging articles with a simple packaging sheet of paperboard which can be quickly and inexpensively manufactured in various sizes and which further can be quickly formed into an easy open article-containing package. The present invention overcomes the drawbacks and disadvantages of the prior art.

SUMMARY OF THE INVENTION

The invention is a single face corrugated paperboard package for containing an article. The package includes a pair of paperboard sheets, each having an interior surface and an exterior surface. A cohesive coating is applied over substantially the entire interior surface of each of the paperboard sheets. A tear strip is disposed on the interior surface of at least one of the paperboard sheets. The tear strip includes an uncoated portion. The uncoated portion has two opposed longitudinal sides defined by a pair of spaced apart lines of intermittent impressions. Optionally, the tear strip may also include a tape disposed between the pair of spaced apart lines of intermittent impressions. The pair of paperboard sheets may be formed from a single sheet of paperboard.

The invention also includes the method of making a single face corrugated paperboard package for containing an article. The method includes providing at least one interior surface portion and at least one exterior surface portion. The interior surface portion may be precoated with a cohesive material. The at least one interior surface portion is attached to the at least one exterior surface portion. This forms a paperboard sheet.

If the interior surface is not precoated, a cohesive coating is applied to substantially all of the interior surface portion except for an uncoated section having two longitudinal sides. One known technique to apply the coating is strip coating. The invention is not limited to the use of strip coating. Optionally, the entire interior surface portion may be coated with the coating.

A pair of spaced apart parallel lines of intermittent impressions are simultaneously pinched on the pair of paperboard sheets. Each one of the pair of spaced apart parallel lines of intermittent impressions are disposed along each side of the uncoated portion such that the pair of lines of impressions are wider than the uncoated portion.

In the case that the entire interior surface portion is coated, a tape is disposed between the pair of lines of intermittent impressions. The tape is not as wide as the distance between the pair of lines of intermittent impressions.

The invention is a package and method of packaging articles with a simple packaging paperboard sheet which can be quickly and inexpensively manufactured in various sizes. Further, the package is an easy opening article-containing package. The invention is also a package that is closed to ambient conditions. The package of the invention eliminates the transfer of contamination, dirt, or moisture to the contents of the package.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENTS

Figure 1A:
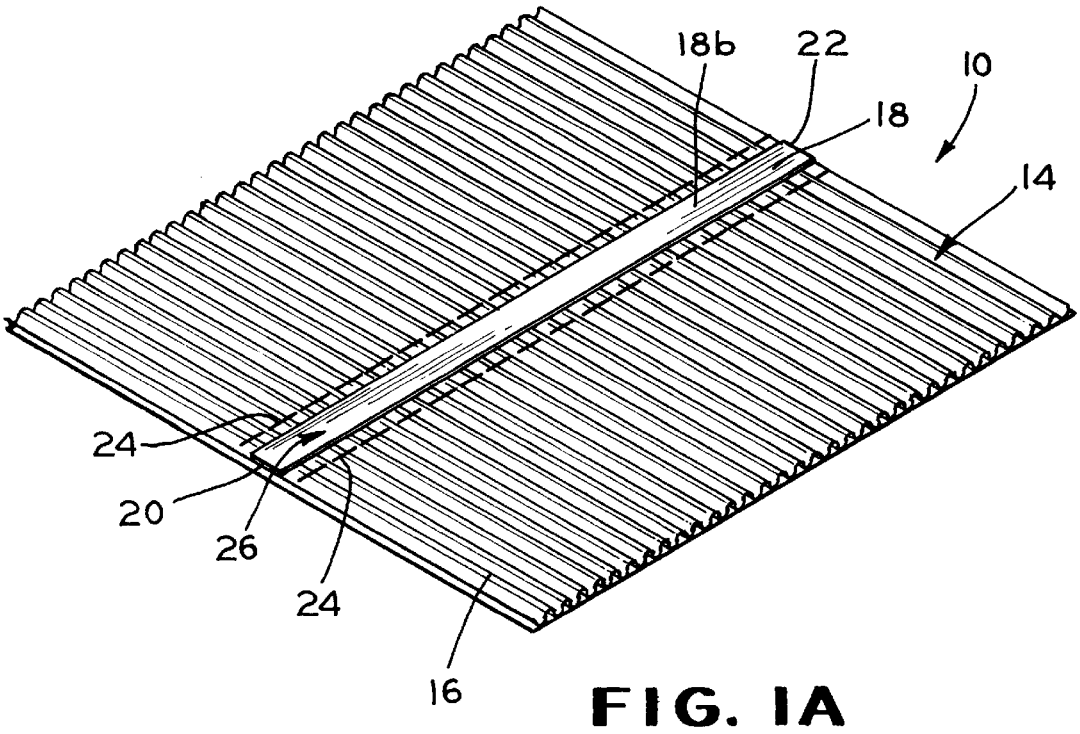
FIG. 1A is a perspective view of a paperboard sheet useful for forming the package made according to the present invention.

Referring to the drawings and, with particular reference to FIG. 1A, a paperboard package 28 (FIG. 3) embodying the present invention is formed from a paperboard sheet 10, preferably composed of a single face corrugated paperboard. As shown, sheet 10 has a generally rectangular configuration with an exterior surface 12 and an interior surface 14. The invention is not limited to a rectangular configuration. Exterior surface 12 is commonly referred to as the liner side and interior surface 14 is commonly referred to as the corrugated or median side.

Sheet 10 utilized to form the package of the present invention includes a coating of a cohesive material 16. The coating 16 is applied to substantially the entire interior surface 14 of the paperboard by known coating techniques. It should be understood that the cohesive material 16 may be any type of cohesive coating well known in the art utilized to create a cohesively coated paperboard that will readily stick and bond to like cohesively coated paperboard, but which does not stick or bond to surfaces which are not coated with the cohesive coating material.

Sheet 10 is also provided with a length of tape 18, preferably polyolefin tape, most preferably polyethylene tape. The tape 18 extends from one edge 20 of sheet 10 to an opposite edge 22 across the interior corrugated surface 14. The tape 18 may extend parallel with or transversely to the ridges disposed on the interior surface 14 of the sheet 10, although transversely to the ridges is preferred due to manufacturing efficiency.

In order to secure the tape 18 to the sheet 10, one side 18*a* of the tape 18 may be coated with a cohesive material compatible with the cohesive material coated on the interior surface 14 of the sheet 10. The opposite or exposed side 18*b* of the tape 18 is free of any adhesive or cohesive coating.

A pair of spaced apart parallel lines of intermittent impressions 24 extend in the same direction as the tape 18 from edge 20 to edge 22. The pair of spaced apart parallel lines of intermittent impressions 24 define a tear strip 26 for gaining access to the interior compartment of the package when the sheet 10, is formed into a package. Tear strip 26 defined by the pair of spaced apart parallel lines of intermittent impressions 24 should be slightly wider in width than tape 18.

Figure 1B:
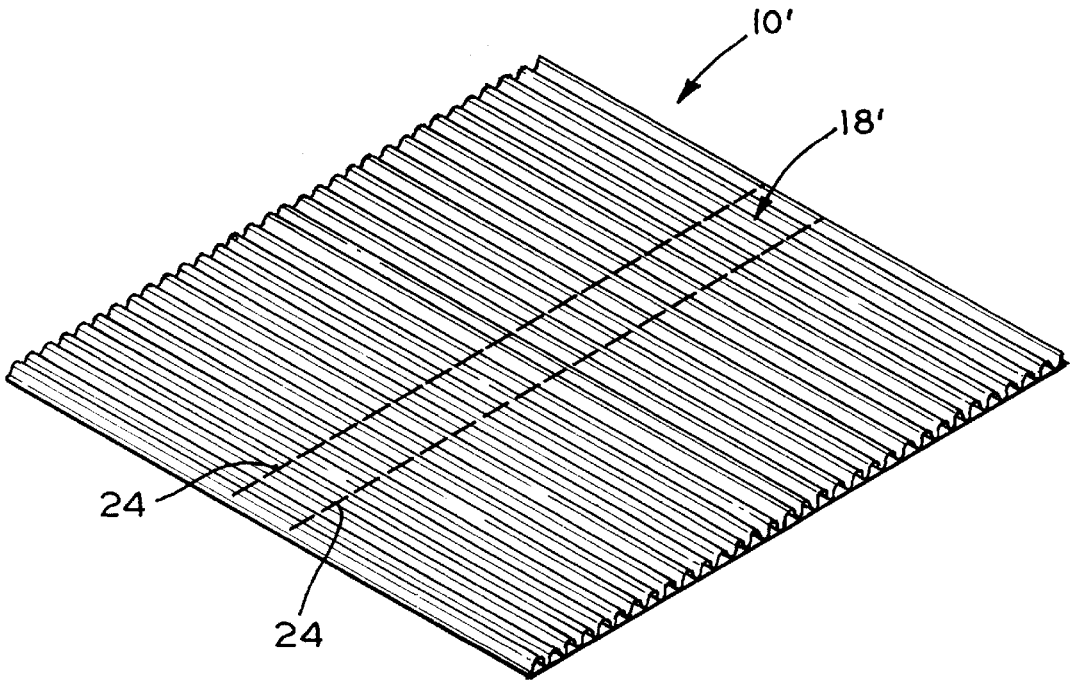
FIG. 1B is a perspective view of the paperboard sheet shown in FIG. 1A without the tape strip.

As shown in FIG. 1B, an alternate embodiment, the sheet 10' is constructed without the tape 18. The coating is applied by a strip coated, in such a manner that a portion 18' of sheet 10', the area between the pair of spaced apart parallel lines of intermittent impressions 24, is not coated. Thus, the tear strip 26 is defined by the pair of spaced apart parallel lines of intermittent impressions 24 and the portion 18' of sheet 10' which is not coated with the cohesive coating 16.

Figure 2:
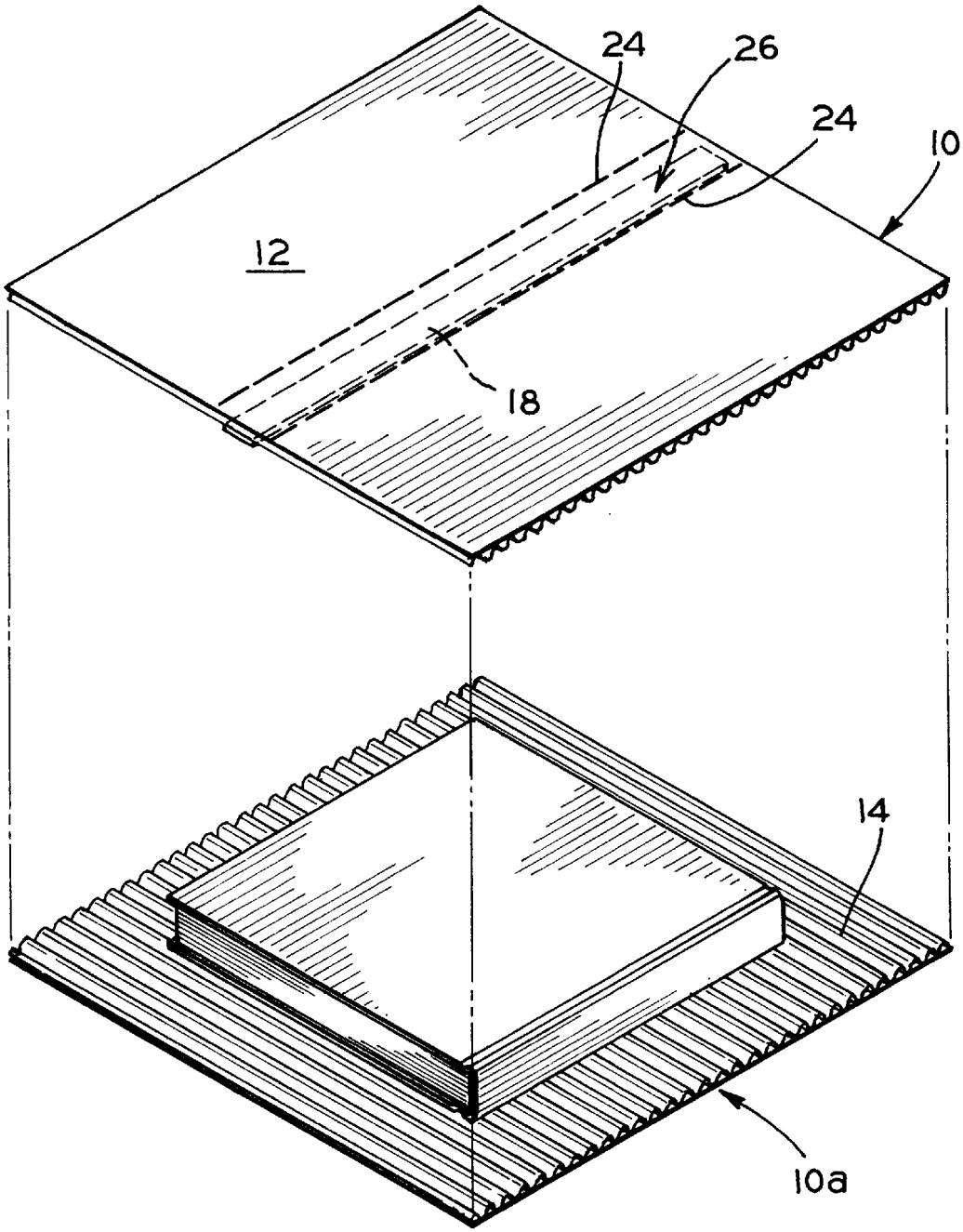
FIG. 2 is an exploded perspective view of a paperboard package according to the present invention, and utilizing the paperboard sheet of FIG. 1A.
Figure 3:
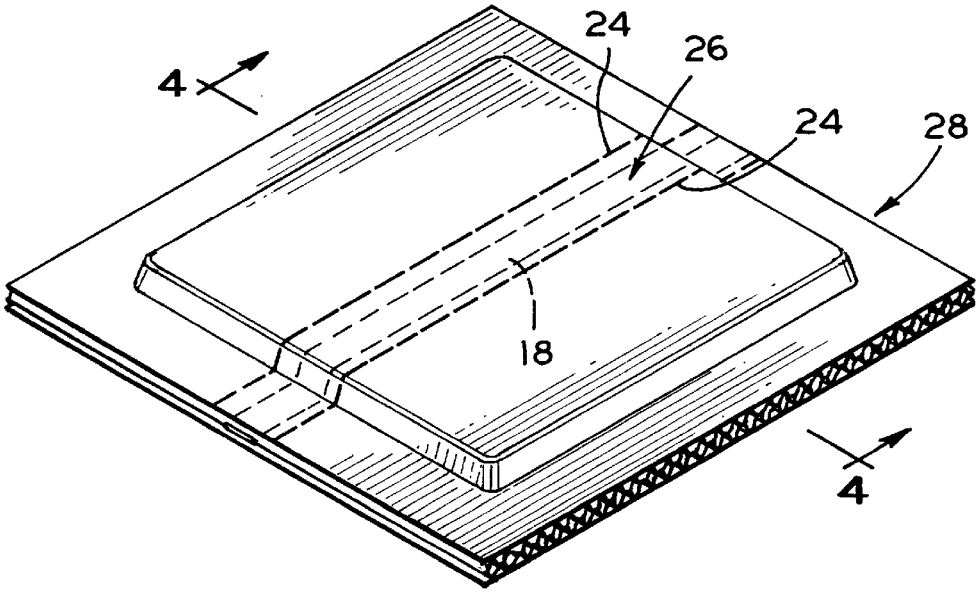
FIG. 3 is a perspective view of the paperboard package shown in FIG. 2.
Figure 4:
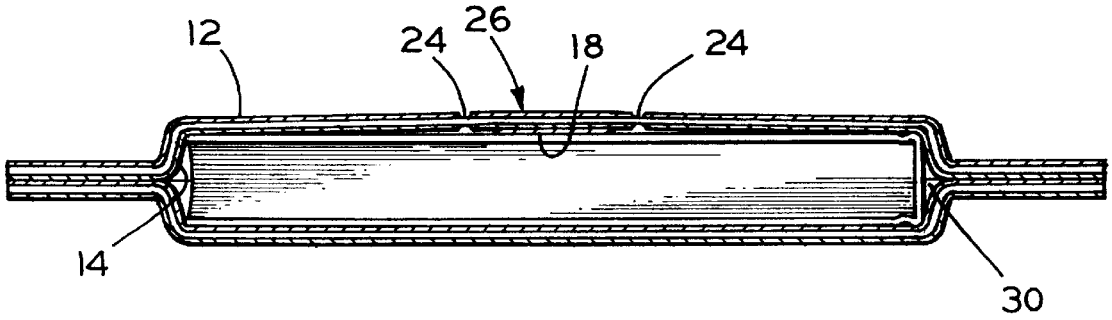
FIG. 4 is a sectional view of the paperboard package shown in FIG. 3, taken in the direction of the arrows along the section line 4—4 of FIG. 3.

Sheet 10 described above is utilized to form package 28 of the present invention illustrated in FIGS. 2–4. Package 28 (FIG. 3) is made utilizing sheet 10 having its interior surface 14 in face to face spaced relationship with the interior surface of a sheet 10*a* which is substantially identical to sheet 10 except that sheet 10*a* does not require a tear strip or tape strip. Like portions of the interior surface of each of the sheets 10 and 10*a* are jointed together, generally around their respective periphery, by cooperation of the cohesive coating 16 applied to their respective interior surfaces. The remaining like portions of each of the sheets 10 and 10*a* are spaced apart to form an interior compartment 30 as shown. Interior compartment 30 conforms to the contour of the article contained within the package. For example, the package 28 is illustrated in exploded form (FIG. 2) showing an article disposed between opposing interior surfaces of sheets 10 and 10*a*. Thus, the interior compartment of package 28 is shaped and sized in dimensions similar to those of the article. It should be noted that the sealing of the like portions of each of the sheets 10 and 10*a* may be done by hand or when speed is of essence, by a stamping or sealing machine of a type well known in the art. In addition, because a cohesive coating is utilized, the interior surfaces of sheets 10 and 10*a* will not bond to the article contained therein.

Access to interior compartment 30 of package 28 is provided by tear strip 26. In the illustrated embodiments, tear strip 26 runs form one edge of the package to an opposite edge of the package. The exposed surface 18*b* of the tape 18 prevents bonding between the adjacent interior surfaces 14 of sheets 10 and 10*a* since the cohesively coated interior surfaces will only bond to other cohesively coated surfaces.

If desired, the package of FIG. 2 may be formed with identical sheets 10, each being coated on their interior surface with a cohesive material, each having a polyolefin tape extending from edge to edge, and each having a pair of spaced apart parallel lines of intermittent impressions extending across the sheet forming a tear strip which extends coextensively with the tape. Thus, the package would have two tear strips one on either side of the package.

Figure 5:
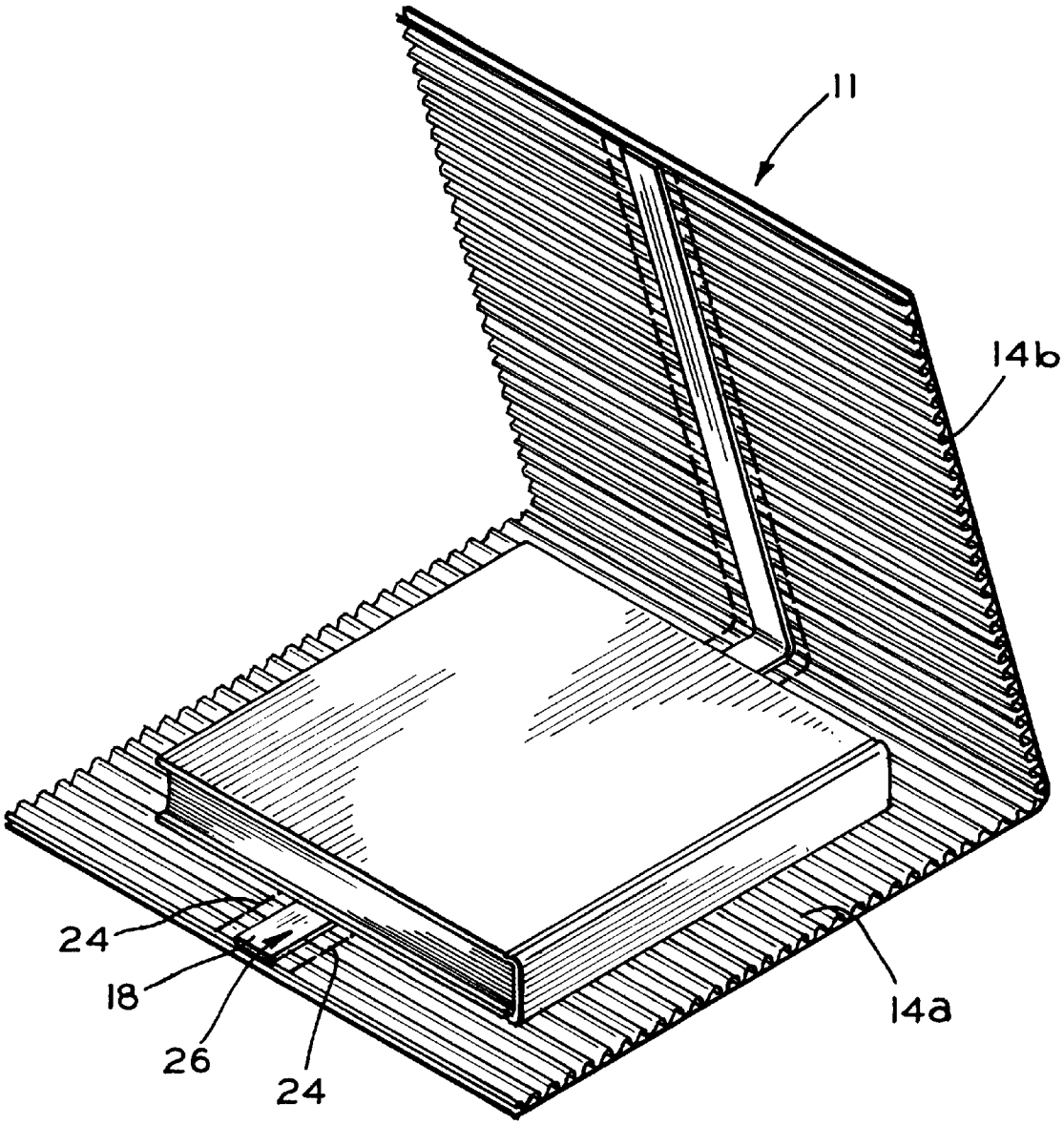
FIG. 5 is a perspective view of an alternate embodiment of the paperboard package shown in FIG. 3.
Figure 6:
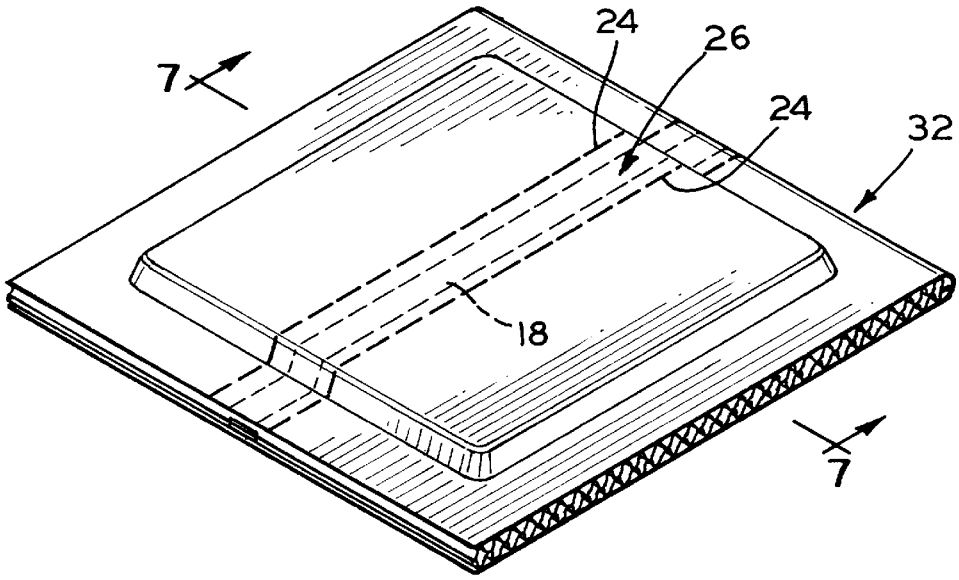
FIG. 6 is a perspective view of a further embodiment of a paperboard package made according to the present invention.
Figure 7:
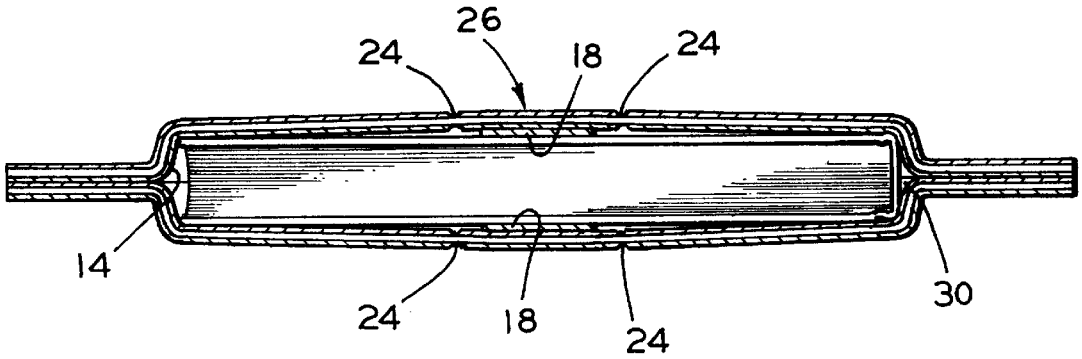
FIG. 7 is a sectional view of the construction shown in FIG. 6, taken in the direction of the arrows along the section line 7—7 of FIG. 6.

An alternate embodiment of a package made according to the present invention is illustrated in FIGS. 5 and 7, and is formed from a single sheet 11. Sheet 11 is substantially identical to sheet 10, and includes the cohesive coating 16 on the interior surface 14, polyethylene tape 18, and a pair of spaced apart parallel lines of intermittent impressions 24 as described above. As shown, however, sheet 11 is generally twice as long as sheet 10 for packaging identically sized articles, enabling it to form both the top and bottom packaging sheets. Package 32 is formed by folding the interior surface of sheet 11 onto itself forming opposing interior surface sections 14*a* and 14*b* of a substantially identical size. An article to be packaged is placed between the opposing interior surface sections 14*a* and 14*b*. The remaining like portions of interior surface portions 14*a* and 14*b* are sealed together by cooperation of the cohesive coating. The remaining like portions of interior surface portions 14*a* and 14*b* are spaced apart forming interior compartment 30. Interior compartment 30 as before, generally conforms to the contour of the article packaged therein.

In package 32, the tear strip 26 formed between the pair of spaced a part parallel lines of intermittent impressions 24 extends around the entire package. The polyolefin tape 18 again prevents bonding between the opposing interior surface sections.

In a further embodiment of the package 32 the tear strip may be defined by the pair of spaced apart parallel lines of intermittent impressions 24 and an uncoated portion 18' of interior surfaces 14*a* and 14*b*. The portion 18' is disposed between the parallel lines of impressions 24.

Sheets 10 and 11 utilized to form packages 28 and 32 according to the present invention are easily manufactured. An interior surface 14 coated with an appropriate cohesive coating 16 is provided. The coated interior surface 14 is attached to exterior surface 12 to form sheet 10. Known techniques are used to attach the coated interior surface 14 and the exterior surface 12. This may also be referred to as forming a paperboard sheet.

Next, sheet 10 travels between a pair of scoring heads. The scoring heads are coordinated to simultaneously pinch the sheet 10 to form the pair of spaced apart parallel lines of intermittent impressions 24.

Further, the tape 18 is applied to the sheet 10. The step of forming the pair of spaced apart parallel lines of intermittent impressions 24 may occur right before or after applying the tape 18.

In an alternate embodiment, the interior surface 14 is not pre-coated. The interior surface 14 is coated by a technique known as strip coating. This allows for the interior surface 14 to be coated except for the portion 18' between the pair of spaced apart parallel lines of intermittent impressions 24. This step must occur before the steps of pinching the sheet 10 and applying the tape 18.

It will be seen that the present invention provides a new and useful easy access tear-open paperboard package and method of making same having a number of advantages and characteristics including those identified herein and others which are inherent in the invention. Further embodiments, of the invention have been described by way of description, and it will be appreciated that modifications may be made to the described embodiments without departing from the spirit of the invention or the scope of the appended claims.

What is claimed is:

1. A single face corrugated paperboard package for containing an article, comprising:

a) a pair of paperboard sheets, each having an interior surface and an exterior surface;

b) a cohesive coating applied over substantially the entire interior surface of each of said paperboard sheets; and, c) a tear strip, including a pair of spaced apart lines of intermittent impressions formed in an uncoated portion on at least one of said pair of paperboard sheets in a manner such that the sheet is not perforated.

2. A paperboard package as defined in claim 1, further comprising a coating applied to said uncoated portion and a tape having a side coated with said cohesive coating disposed between said pair of spaced apart lines of intermittent impressions, and said coated side of said tape facing said interior surface of said at least one of said pair of paperboard sheets.

3. A paperboard package as defined in claim 2, wherein said tape is polyethylene.

4. A paperboard package as defined in claim 1, wherein said interior surface is corrugated.

5. A paperboard package as defined in claim 4, wherein said tear strip is oriented either transverse or parallel to said corrugated interior surface.

6. A paperboard package as defined in claim 1, wherein said tear strip is disposed on both of said pair of paperboard sheets.

7. A single face corrugated paperboard package for containing an article, comprising:

a) a pair of paperboard sheets, each having an interior surface and an exterior surface;

b) a cohesive coating applied over said interior surface of each of said pair of paperboard sheet; and, c) a tear strip, including a pair of spaced apart lines of intermittent impressions formed in at least one of said pair of paperboard sheets, and a tape disposed along said interior surface of at least one of said paperboard sheets, said tape having a bottom surface which is bonded to said interior surface of at least one of said paperboard sheets within a space defined between said spaced apart lines of intermittent impressions and having a top surface which does not adhere to said cohesive coating, said pair of spaced apart lines of intermittent impressions being spaced apart wider than said tape.

8. A paperboard package as defined in claim 7, wherein said tape is disposed on both of said pair of paperboard sheets.

9. A paperboard package as defined in claim 7, wherein said interior surface is corrugated and said tear strip is disposed either transverse or parallel to said corrugated interior surface.

10. A paperboard package as defined in claim 7, wherein said tape is polyethylene tape.

11. A single face corrugated paperboard package for containing an article, comprising:

a paperboard sheet having an interior surface and an exterior surface;

a cohesive coating applied over substantially the entire interior surface of said paperboard sheet; and an uncoated portion on said interior surface of said paperboard sheet, said uncoated portion having two longitudinal sides defined by a pair of spaced a part lines of intermittent impressions formed in a manner such that the sheet is not perfortated;

whereby the package is formed by folding said paperboard sheet such that said interior surface has two sections in a facing relationship.

12. A paperboard package as defined by claim 11, wherein said tear strip extends along the entire length of said interior surface.

13. A paperboard package as defined in claim 11, wherein said cohesive coating is applied over said uncoated portion and further comprising a tape disposed between said pair of spaced apart lines of intermittent impressions.

14. Method of making a single face corrugated paperboard package for containing an article, comprising:

providing at least one paperboard sheet having an interior surface portion and an exterior surface portion;

with a cohesive coating applied to substantially all of the interior surface portion except for an uncoated section having two longitudinal sides; and pinching without piercing the paperboard sheet to form spaced apart parallel lines of intermittent impressions, said spaced apart parallel lines of intermittent impressions being disposed along each side of the uncoated portion such that the uncoated portion is between said lines of intermittent impressions.

15. A method as defined in claim 14, further comprising applying the cohesive coating to the uncoated portion before said pinching and applying a tape between the pair of spaced apart parallel lines of impressions.

16. A method as defined in claim 14, wherein said cohesive coating is applied by strip coating.

17. A method as defined in claim 14, further comprising folding the paperboard sheet such that the interior surface portion forms two sections in a facing relationship.

18. A method as defined in claim 17, further comprising sealing the package.

19. A method as defined in claim 18, wherein sealing the package by at least one of the following techniques consisting of by hand, stamping, and pinching.

20. A paperboard package as defined in claim 1, wherein said pair paperboard sheets comprise a single sheet of paperboard.

* * * * *